United States Patent [19]

Rogers, Jr. et al.

[11] 4,226,469

[45] Oct. 7, 1980

[54] RECLINER CHAIR WITH WALL-AVOIDING ACTION

[75] Inventors: Walter C. Rogers, Jr., Denton; David S. Hoffman, High Point, both of N.C.

[73] Assignee: Royal Development Company, Inc., High Point, N.C.

[21] Appl. No.: 5,810

[22] Filed: Jan. 23, 1979

[51] Int. Cl.[3] ..... A47C 1/02

[52] U.S. Cl. ..... 297/85; 297/322

[58] Field of Search ..... 297/75, 83, 84, 85, 297/86, 322

[56] References Cited

U.S. PATENT DOCUMENTS

| | | | |
|---|---|---|---|
| 3,493,264 | 2/1970 | Re [1] | 297/75 X |
| 3,743,348 | 7/1973 | Sloan | 297/85 |
| 3,743,349 | 7/1973 | Crum et al. | 297/85 |
| 3,937,518 | 2/1976 | Harrison | 297/83 |

*Primary Examiner*—James T. McCall
*Attorney, Agent, or Firm*—William E. Mouzavires

[57] ABSTRACT

A handle-operated recliner chair has a seat mounting linkage consisting of two mounting links mounting the seat directly to a stationary base for movement between normal and reclining positions. A footrest is mounted to the front of the seat by a footrest linkage which is extended and retracted through means of a handle mounted relative to the seat to rotate a torque tube which is connected to the footrest linkage to operate the same. One of the links of the footrest linkage is directly connected to the front mounting link of the seat such that extension of the footrest will cause the seat mounting links to pivot forwardly to not only place the seat in an inclined position but also, to move the seat forwardly relative to the base to provide wall-avoiding action which comes in to play when the backrest is reclined to avoid striking a nearby wall with the backrest. The backrest may be either fixed rigidly to the seat to move together with the seat as a unit to provide a "one-way" recliner or as an alternative, it may be mounted by means of a novel backrest linkage to the seat to move relative to the seat to provide a "three-way" recliner chair. In either instance, the backrest linkage is totally independent of the seat mounting linkage and the footrest linkage.

16 Claims, 5 Drawing Figures

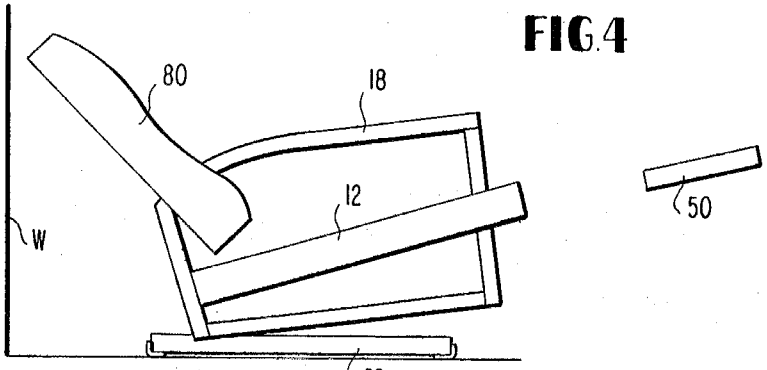
FIG. 4
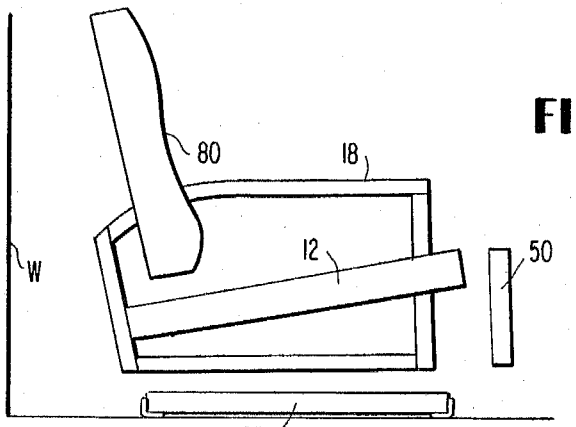
FIG. 3
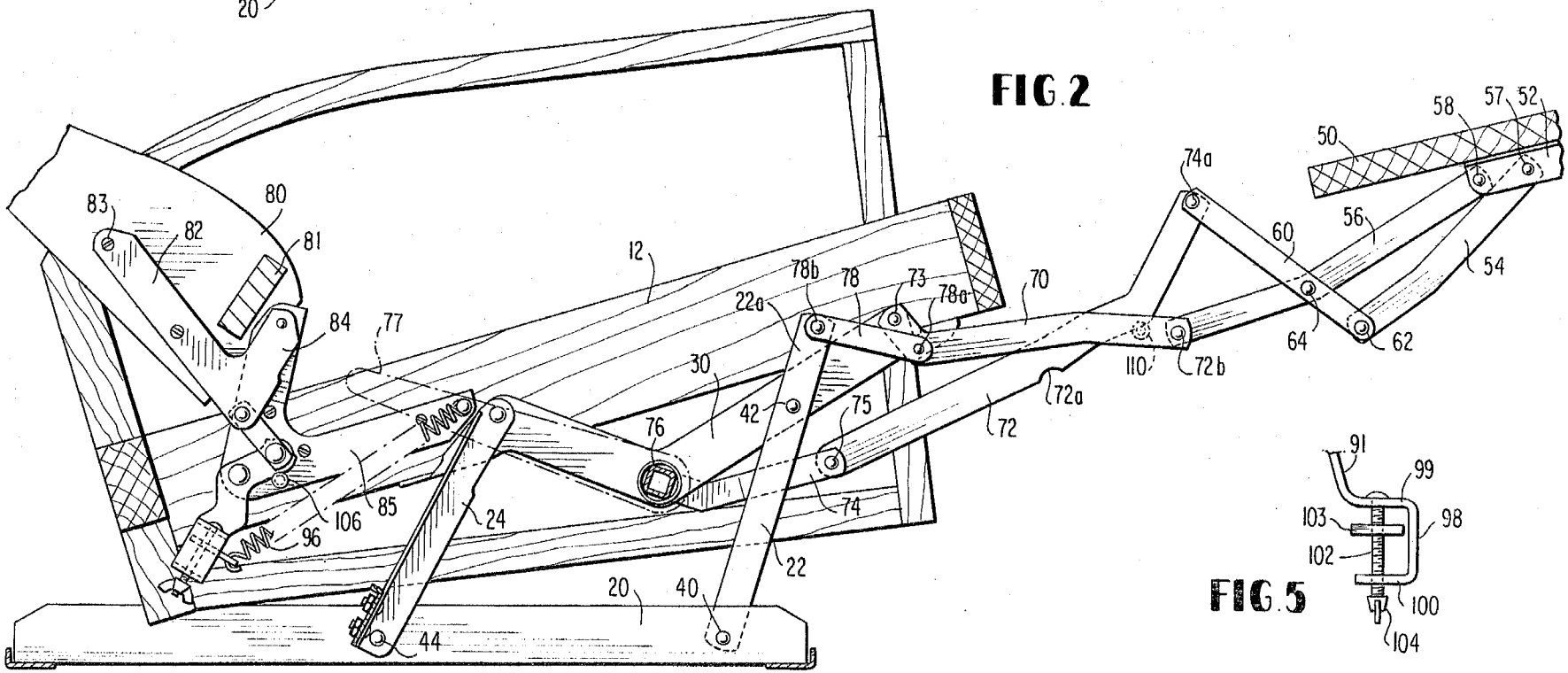
FIG. 2
FIG. 5

RECLINER CHAIR WITH WALL-AVOIDING ACTION

OBJECTS OF THE INVENTION

It is a primary object of the present invention to provide a recliner chair having a relatively simple linkage system for mounting and operating its moving parts and yet provides wall-avoiding action which permits the chair to be placed adjacent a wall without striking the wall when the chair is moved into reclining positions. Included herein is such a recliner chair including a footrest which may be moved between extended and retracted positions by means of an operating handle and in which the footrest has a certain linkage associated with it that causes the seat of the chair to move forwardly relative to the base into a comfortable reclining position which also provides the wall-avoiding action.

It is another primary object of the present invention to provide a reclining chair which will achieve the above objects and yet, may be equipped with a backrest that is either rigidly fixed to the seat to move with the seat as a unit so as to provide a "one-way" recliner chair or, in the alternative, may be mounted to the seat to move relative to the seat so as to provide a "three-way" recliner chair. A "one-way" recliner chair as used herein is meant to define a recliner chair having a unitary seat, back and arm that always move together as a unit. Included herein is the provision of a novel backrest linkage mechanism for mounting the backrest relative to the seat to permit the backrest to move relative to the seat into various reclining positions independently of other linkage mechanism which mounts the seat relative to the base. Included herein is such a novel backrest mounting linkage which utilizes a spring for biasing the backrest into a normal reclining position.

SUMMARY OF INVENTION

According to one preferred embodiment of the invention, a recliner chair has a seat mounted relative to an underlying fixed base by means of front and rear seat mounting links whose opposite ends are pivotally mounted relative to the seat and the base. A footrest has a footrest linkage mounted to the seat to be actuated by means of a manual control handle mounted on one side of the chair relative to the seat. Movement of the control handle in one direction extends the footrest linkage to project the footrest forwardly of the chair for reclining, and movement of the handle in the opposite direction, retracts the footrest to a position extending generally vertically below the front of the seat. One of the links included in the footrest linkage is directly connected to the front seat mounting link such that when the footrest is extended, the front seat mounting link will be actuated fowardly to place the seat into a comfortable reclining position while, at the same time, moving the seat forwardly relative to the base to provide wall-avoiding action.

In the preferred embodiment, the backrest is mounted to the seat for movement relative to the seat between upright and reclining positions by means of a novel backrest linkage including a first backrest mounting link fixed to the backrest and a second backrest mounting link fixed to the seat and pivotally connected to the first backrest mounting link. A knuckle linkage is provided between the backrest mounting links; the knuckle linkage including a pair of short knuckle links pivotally mounted to the backrest mounting links, respectively, and also being pivotally interconnected to form a knuckle joint which, upon exerting pressure on the backrest, will collapse permitting the backrest to be moved into a number of reclining positions relative to the seat.

One of the knuckle links has a depending spring mounting portion for mounting one end of a tension coil spring whose opposite end is anchored relative to the seat so as to bias the knuckle linkage in what may be termed an "extended position" biasing the backrest towards upright or normal position. When sufficient pressure is exerted on the backrest by the chair occupant, to overcome the biasing force of the spring, the knuckle links will fold pivoting relative to each other to permit the backrest to be moved to a desired reclining position against the bias of the spring. When backrest pressure is removed from the backrest by the chair occupant, such as by leaning forward in the chair, the pressure of the spring will return the backrest towards normal or upright position. Preferably, the mounting of the biasing spring to the lower knuckle link is achieved through an adjusting screw so that the biasing force of the spring may be adjusted.

It it is desired to convert the chair into a "one-way" recliner chair, that is, with the backrest rigidly fixed to the seat to move together with the seat as a unit at all times, the backrest mounting linkage may be removed and replaced by a single backrest mounting link rigidly fixed to the backrest at one end and rigidly fixed to the seat at the opposite end.

DRAWINGS

Other objects and advantages of the present invention will become apparent from the following more detailed description of the drawings in which:

FIG. 2 is a view generally similar to FIG. 1 except that the chair parts are shown in a fully reclined position, that is, with the footrest extended and with the backrest reclined relative to the seat and with the seat reclined and positioned forwardly relative to the base;

FIG. 3 is a diagrammatic view of the basic chair parts when in the position corresponding to that shown in FIG. 1;

FIG. 4 is a view similar to FIG. 3 but showing the chair parts in the position corresponding to that shown in FIG. 2; and FIG. 5 is a detail view of one of a portion of a knuckle linkage utilized to mount a spring which biases the backrest towards upright position.

DETAILED DESCRIPTION

Figure 1:
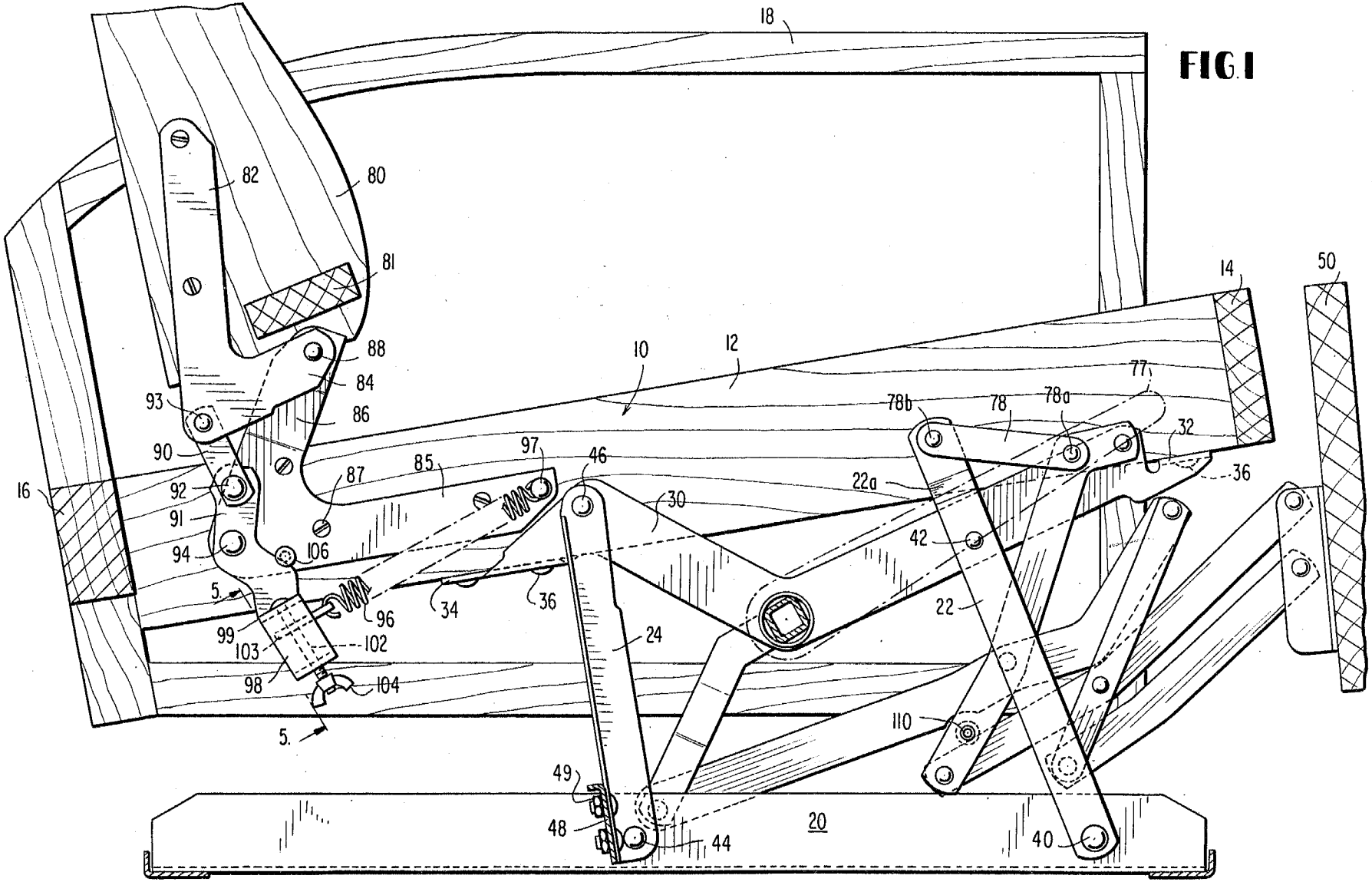
FIG. 1 is a side elevational view of a chair embodying the present invention shown with the upholstery removed and with the associated linkage system on one side of the chair in an upright or normal position.

Referring now to the drawings in detail, there is shown for illustrative purposes only, a "three-way" reclining chair embodying the present invention and including a seat whose frame is only shown and which includes opposite side rails 12 which may be formed from any suitable material such as wood interconnected by front and rear rails 14 and 16 to define a generally rectangular frame. The armrests of the chair which, of course, will be upholstered together with the seat in the finished product, are represented by the armrest frames 18 which are fixed to the seat to move with the seat as a unit at all times.

Seat 12 is mounted relative to an underlying fixed base, which may be formed from a rectangular frame of metallic channel parts, or any other suitable structure. The base frame includes opposite side rails, one of which is shown at 20 in FIG. 1. Mounting of the seat relative to the base is achieved by a "seat mounting linkage" including front and rear seat mounting links 22 and 24, respectively. Front and rear seat mounting links 22 and 24 are each pivotally connected to the seat and to the base and, in the shown embodiment, the connection to the seat is achieved through a "seat link" 30 which is fixed to the seat 12 by means of horizontal flanges 34 and 32 which underlie the seat 12 and are secured thereto by means of screws 36 as shown in FIG. 1. Front seat mounting link 22 is pivoted to seat link 30 by means of a pivot 42 and is pivoted to base 20 by means of a pivot 40. Rear seat mounting link 24 is pivoted to seat link 30 by means of a pivot 46 and is pivoted to base 20 by means of pivot 44. It will be seen from FIG. 1, that when the chair is in normal or upright position, the front and rear seat mounting links 22 and 24 will extend from the base upwardly and slightly rearwardly in a generally parallel interrelationship.

The chair also typically includes a footrest whose frame is shown at 50 which is mounted for movement between a retracted position where it extends downwardly at the front of the seat in generally vertical position as shown in FIG. 1, and extended position where it is projected forwardly from the front of the seat in a horizontal elevated position as shown in FIG. 2. Referring to FIG. 2, footrest 50 has an associated "footrest linkage" for mounting it to the seat and for extending and retracting it relative to the seat. The footrest linkage includes a bracket 52 fixed to the rear side of footrest 50; and a pair of links 54 and 56 pivoted at one of their ends to bracket 52 by pivots 57 and 58 respectively.

The footrest linkage further includes a link 60 having one end pivotally connected by pivot 62 to one end of link 54 and having an intermediate portion pivotally connected by pivot 64 to an intermediate portion of link 56. Link 56 extends beyond link 60 where it is pivoted by pivot **72*b* to one end of what is termed a "footrest mounting link" 70 whose opposite end is pivoted by pivot 73 to the seat link 30. Link 70 is pivoted intermediate its ends to link 72 by pivot 70*a*. Link 60 is pivotally connected to the forward end of a "footrest extension link" 72 by means of a pivot 74*a*. The opposite, rear end of footrest extension link 72 is pivotally connected to a footrest actuating crank 74 by means of a pivot 75. Footrest actuating crank is fixed to a torque tube 76 mounted in a passage in the seat link 30 so as to be rotatable by means of a manual control handle 77 which is positioned on one side of the chair. Torque tube 76 extends transversely of the chair under the seat; it being understood that the chair has a linkage system similar to the one disclosed on opposite sides of the chair, and the torque tube is mounted in the seat links 30 fixed to opposite side rails 12** of the seat.

When the chair is in the normal or upright position, the footrest is folded with the parts shown in FIG. 1. When it is desired to project the footrest to the extended position shown in FIG. 1 to the forward position shown in FIG. 2 which causes rotation of torque tube 76 which, in turn, rotates footrest actuating crank 74 to project footrest extension link 72 which causes unfolding of link 60 and actuation of the other links of the footrest linkage to place the footrest in a desired elevated and projected position relative to the seat as shown in FIG. 2. Return of the footrest to the retracted position shown in FIG. 1 is, of course, achieved by opposite rotation of manual handle 77.

The various linkage mechanisms described thus far may be considered conventional or, at least, residing in the prior art and themselves form no part of the present invention.

However, in accordance with one aspect of the present invention, footrest mounting link 70 is directly connected by a "seat actuating" link 78 to an upper portion **22*a* of the front seat mounting link 22 which projects beyond its pivoting 42 to seat link 30. Pivot 78*a* connects the forward end of actuating link 78 to a intermediate portion of footrest mounting link 70 adjacent pivot 73, while pivot 78*b* pivotally connects the rear end portion of actuating link 78 to the upper end portion 22*a* of front seat mounting link 22. It will thus be seen that when the footrest is extended to the position shown in FIG. 2, link 78 will be moved forwardly by footrest mounting link 70 to, in turn, cause front seat mounting link 22 to pivot forwardly about pivot 40 to the base 20, thus causing the seat 12 to move forwardly relative to base 20 and into a reclined position with the front of seat 12 moving upwardly and forwardly and with the rear of seat 12 moving downwardly and fowardly relative to the base. The change in position of seat 12 relative to base 20 and relative to the horizontal may be seen by comparing FIGS. 3 and 4 which correspond to FIGS. 1 and 2, respectively. When the footrest is moved from the extended to retracted position by handle 77, it will be seen that the seat actuating link 78 will cause front seat link 22 to pivot rearwardly about the pivot 40 to return the seat into the normal position shown in FIGS. 1 and 3**.

In accordance with the present invention, the backrest 80 in the preferred embodiment is pivotally mounted to the seat to be movable relative to the seat between a normal position shown in FIGS. 1 and 3 and a plurality of reclining positions, the ultimate of which is shown in FIGS. 2 and 4. This is achieved by a novel backrest mounting linkage which includes a first backrest mounting link 82 having a generally L-shape and being fixed by screws 83 to backrest 80; and a second backrest mounting link 85 being fixed by screws to seat 12. The second backrest mounting link 85 in the specific embodiment has a generally V-shape. The lower leg 84 of backrest mounting link 82 and the upper leg of the backrest mounting link 85 are pivotally interconnected by pivot 88.

In addition, backrest mounting links 82 and 85 are pivotally interconnected by what will be termed a "knuckle linkage", including a pair of short knuckle links 90 and 91 pivotally connected to each other by pivot 92. Knuckle link 90 is pivotally connected by pivot 93 to a lower portion of backrest mounting link 82, while knuckle link 91 is pivotally mounted by pivot 94 to backrest mounting link 85.

Knuckle links 91 and 92 are biased into an extended or unfolded position shown in FIG. 1 for normally retaining the backrest in upright position by means of a tension coil spring 96, one end of which is anchored by a pin 97 to seat 12. The opposite end of spring 96 is connected relative to a lower extension of knuckle link 91 which is formed as a generally U-shaped channel 98 having an upper flange 99 and a lower flange 100 joined by an adjusting screw 102. The latter is threaded through a mounting lug 103 which receives one end of spring 96.

Channel 98 is also shown in FIG. 5. Adjusting screw 102 is received through apertures formed in flanges 99 and 100, and a wing nut 104 is provided on the lower end of adjusting screw 102. The tension of the spring may be adjusted by adjusting the position of mounting lug 103 along screw 102.

The tension of spring 96 exerts a very strong biasing force on lower knuckle link 91 tending to pivot link 91 in a counterclockwise direction as shown in FIG. 1 about pivot 94 which will tend to maintain the knuckle links 90, 91 in extended or unfolded position shown in FIG. 1. This position of the knuckle links is determined by a stop pin 106 fixed to the backrest mounting link 85 to be engageable with a forward edge portion of lower knuckle link 91 as shown in FIG. 1. When the chair occupant exerts a sufficient force against backrest 80, the biasing force of spring 96 will be overcome to collapse or fold the knuckle joint at pivot 92 forwardly so that the knuckle links pivot relative to each other into the position shown in FIG. 2, thereby permitting the backrest to move into a reclined position. A number of different reclining positions may be achieved depending on the pressure exerted on the backrest 80, however, an ultimate reclining position is determined by stop 106 upon engagement with another forward edge portion of the knuckle link 91 as shown in FIG. 2. When the occupant releases back pressure on the backrest 80, spring 96 will pivot lower knuckle link 91 in a counter-clockwise direction about pivot 94 to return the backrest towards normal or upright position shown in FIG. 1.

The extended position of the footrest 50 is achieved by another stop 110 fixed to footrest mounting link 70 so as to be engageable with a lower edge portion of extension link 72 as shown in FIG. 2. Extension link 72 is provided with a recess **72*a* for accommodating the stop 110 when the footrest linkage is in the retracted position shown in FIG. 1**.

Although the preferred embodiment shown includes the novel backrest linkage described above, the recliner chair may be converted to a "one-way" recliner chair by removing the backrest linkage shown and described, and by replacing it with a single backrest mounting link (not shown) which is rigidly fixed to the backrest 80 and which is also rigidly fixed to the seat 12 so that the backrest 80 will be united with the seat 12 as one unit.

What is claimed is:

1. In a recliner chair having a seat, a base, front and rear seat mounting links both pivotally connected to the base and both pivotally connected to the seat to mount the seat for movement relative to the base between normal and reclining positions, a footrest, a footrest linkage mounting the footrest to the seat for movement between a retracted position adjacent the seat and an extended position projected forwardly from the seat, the footrest linkage including a footrest mounting link having one end pivotally connected to the seat, and manual means for actuating the footrest linkage to move the footrest between the extended and retracted positions thereof, the manual actuating means including linkage connected to the footrest linkage for operating the same between said positions thereof; the improvement comprising an extension of said front seat mounting link projecting above the pivotal connection of the front seat mounting link to the seat, and a seat actuating link having one end portion pivotally connected to said footrest mounting link and having an opposite end portion pivotally connected to said extension of said front seat mounting link such that when the footrest is moved to the extended position, said seat actuating link will pivot said front mounting link about its pivotal connection to the base to move the seat forwardly relative to the base into an inclined position forwardly of the base.

2. The recliner chair defined in claim 1 wherein said seat actuating link is pivotally connected to said footrest mounting link adjacent the pivotal connection of the footrest mounting link to the seat.

3. The recliner chair defined in claim 1 wherein there is further included a backrest and backrest linkage means pivotally mounting the backrest to the seat for movement between a generally upright position and a reclined position, said backrest linkage means including a first backrest link fixed to the backrest, a second backrest link fixed to the seat and pivotally connected to the first backrest link, a knuckle linkage interconnecting the first and second backrest links and movable between an extended position when the backrest is in the generally upright position and a retracted folded position when the backrest is reclined relative to the seat, and spring means biasing the knuckle linkage into its extended position but permitting the knuckle linkage to be moved into said retracted position thereof when sufficient pressure is exerted against the backrest to move the backrest into a reclining position relative to the seat.

4. The chair defined in claim 3, further including stop means fixed to the seat and engageable with spaced portions of the knuckle linkage for defining extended and folded positions of the knuckle linkage.

5. The recliner chair defined in claim 4 wherein said knuckle linkage includes a first link pivotally connected to the first backrest link, a second link pivotally connected to the second backrest link, said first and second knuckle links being pivotally connected to each other.

6. The recliner chair defined in claim 5 wherein said second link of the knuckle linkage has a portion projecting below the point of its pivotal connection to the seat and wherein said spring means is connected at one end to said last defined portion of the second link of the knuckle linkage.

7. In a recliner chair having a base, a seat, a seat linkage mounting the seat relative to the base, a backrest, and backrest linkage pivotally mounting the backrest to the seat for movement between a normal generally upright position and a plurality of reclined positions; the improvement wherein said backrest linkage includes a first backrest link fixed to the backrest, a second backrest link fixed to the seat, said first and second backrest links being pivotally connected to each other, a knuckle linkage pivotally interconnecting said first and second backrest links for movement between an extended position when the backrest is in the normal generally upright position and a retracted folded position when the backrest is in a reclined position, and spring means biasing said knuckle linkage to said extended position thereof but permitting said knuckle linkage to move to a retracted position when sufficient pressure is exerted on the backrest, permitting the backrest to move into a reclined position relative to the seat, and wherein said knuckle linkage includes a first knuckle link pivotally connected to the first backrest link, a second knuckle link pivotally connected to the second backrest link, said first and second knuckle links being pivotally connected to each other.

8. The chair defined in claim 7, further including stop means fixed to the seat and engageable with spaced portions of the knuckle linkage for defining extended and folded positions of the knuckle linkage.

9. The recliner chair defined in claim 7 wherein said second knuckle link has a portion projecting below its pivotal connection to the second backrest link and wherein said spring means is connected at one end to said last defined portion of the second knuckle link.

10. The recliner chair defined in claim 9 further including stop means fixed to the seat and engageable with spaced portions of said second knuckle link for defining extended and folded positions of the knuckle linkage.

11. A backrest linkage for use in pivotally mounting a backrest to a seat in a reclining chair enabling the backrest to be moved between a normal generally upright position and a plurality of reclined positions extending at an angle relative to the seat; the backrest linkage comprising first and second backrest links adapted to be fixed to a backrest and a seat of an associated recliner chair, said backrest links being pivotally connected to each other, a knuckle linkage pivotally interconnecting said first and second backrest links and being movable between an extended position when the backrest of an associated chair is in a generally upright position and a retracted folded position when the backrest of the associated chair is in a reclined position, and spring means having one end fixed to the second backrest link and another end connected to the knuckle linkage for biasing the knuckle linkage into said extended position thereof but permitting the knuckle linkage to be moved to a retracted folded position when the first backrest link is pivoted relative to the second backrest link upon application of pressure to an associated backrest to which the first backrest link is adopted to be fixed, and wherein said knuckle linkage includes a first knuckle link pivotally connected to the first backrest link, a second knuckle link pivotally connected to the second backrest link, said first and second knuckle links being pivotally interconnected.

12. The backrest linkage defined in claim 11 wherein said spring means is connected at one end to said second knuckle link at a point spaced from the pivotal connection of the second knuckle link to the second backrest link.

13. The backrest linkage defined in claim 12 further including a stop fixed to the second backrest link and being engageable with spaced portions along the second knuckle link for defining the extended position of the knuckle linkage and a retracted folded position of the knuckle linkage.

14. The backrest linkage defined in claim 13 wherein said second knuckle link includes a spring mounting lug and adjusting means for adjusting the position of the spring mounting lug along the second knuckle link, said spring means being connected at said one end thereof to said mounting lug.

15. The backrest linkage defined in claim 14 wherein said adjusting means includes a screw mounted in said second knuckle link and wherein said lug has threads receiving said screw.

16. The backrest mounting linkage defined in claim 14 wherein said spring means is a tension coil spring.

* * * * *